US005742211A

United States Patent [19]

Lauf et al.

[11] Patent Number: 5,742,211

[45] Date of Patent: Apr. 21, 1998

[54] RADIO-FREQUENCY AND MICROWAVE LOAD COMPRISING A CARBON-BONDED CARBON FIBER COMPOSITE

[75] Inventors: Robert J. Lauf, Oak Ridge; April D. McMillan, Knoxville, both of Tenn.; Arvid C. Johnson, Lake in the Hills, Ill.; Carl A. Everleigh, Raleigh, N.C.; Arthur J. Moorhead, Knoxville, Tenn.

[73] Assignee: Lockheed Martin Energy Systems, Inc., Oak Ridge, Tenn.

[21] Appl. No.: 620,616

[22] Filed: Mar. 22, 1996

[51] Int. Cl.[6] ..... H01P 1/26; H01P 1/22

[52] U.S. Cl. ..... 333/22 R; 333/22 F; 333/81 A; 333/81 B

[58] Field of Search ..... 333/22 R, 22 F, 333/81 A, 81 B; 342/1–4

[56] References Cited

U.S. PATENT DOCUMENTS

| | | | |
|---|---|---|---|
| 2,550,689 | 5/1951 | Gustafson | 333/22 R |
| 2,646,549 | 7/1953 | Ragan et al. | 333/22 R |
| 2,804,598 | 8/1957 | Fano | 333/22 R |
| 2,881,399 | 4/1959 | Leyton | 333/22 R |
| 2,908,875 | 10/1959 | Blatt et al. | 333/22 R |
| 3,036,280 | 5/1962 | Woodcock | 333/22 R |
| 3,914,714 | 10/1975 | Johnson | 333/22 R |
| 4,023,174 | 5/1977 | Wright | 342/4 |
| 5,243,464 | 9/1993 | Lauf et al. | 359/614 |
| 5,313,325 | 5/1994 | Lauf | 359/614 |
| 5,394,149 | 2/1995 | Fujita et al. | 342/1 |
| 5,469,128 | 11/1995 | Kawanishi et al. | 333/22 R |

*Primary Examiner*—Paul Gensler

*Attorney, Agent, or Firm*—James M. Spicer

[57] ABSTRACT

A billet of low-density carbon-bonded carbon fiber (CBCF) composite is machined into a desired attenuator or load element shape (usually tapering). The CBCF composite is used as a free-standing load element or, preferably, brazed to the copper, brass or aluminum components of coaxial transmission lines or microwave waveguides. A novel braze method was developed for the brazing step. The resulting attenuator and/or load devices are robust, relatively inexpensive, more easily fabricated, and have improved performance over conventional graded-coating loads.

16 Claims, 5 Drawing Sheets

Sect 1 – 1

Sect 2 – 2

Sect 1 – 1

Sect 2 – 2

RADIO-FREQUENCY AND MICROWAVE LOAD COMPRISING A CARBON-BONDED CARBON FIBER COMPOSITE

This invention was made with Government support under contract DE-AC05-84OR21400 awarded by the Office of Energy Efficiency and Renewable Energy, U.S. Department of Energy to Lockheed Martin Energy Systems, Inc. The Government has certain rights in the invention.

FIELD OF THE INVENTION

The present invention relates to the field of attenuators and load elements. More specifically, it relates to improved microwave and/or radio-frequency (RF) attenuators having higher power absorption capability.

BACKGROUND OF THE INVENTION

In the field of radio-frequency (RF) and microwave circuits, resistive devices or loads are used for a variety of purposes including: a resistive circuit element per se; an energy-dissipative element, for example, to absorb reflected power in conjunction with a circulator or isolator; and as a calibrated energy-dissipative element, particularly during testing of high-power microwave sources.

It is well known in the art, and can be shown using traditional transmission line theory, that the resistance of a load must ideally be graded in some way along its length in order to avoid reflections that would tend to propagate back into the circuit. One conventional way of grading the resistance is to apply a resistive coating, which may be carbon film on BeO, to the central conductor of a coaxial transmission line. The thickness of the resistive coating is gradually increased along its length, crudely approximating the desired resistance profile.

The aforementioned method has several disadvantages that limit its usefulness, particularly at high power. First, it is difficult to apply the resistive coating in a well-controlled and reproducible manner. Second, the coating is usually very thin and fragile, and tends to spall from thermal shock. Third, all of the power is dissipated in the thin coating, and it is difficult to cool the coating because of poor thermal coupling, particularly to the outer wall of the load.

SUMMARY OF THE INVENTION

Accordingly, it is an object of this invention to provide an RF load having improved capability for absorbing and dissipating power.

Another object is to provide an RF load or microwave attenuator that is robust, simple to manufacture, and easy to cool during operation.

A third object is to provide an RF load that is reproducible and accurately replicates a desired resistance profile.

Yet another object is to provide an RF load or microwave attenuator in which the energy is dissipated in a bulk material rather than in a thin coating or film.

In accordance with one aspect of the present invention, the foregoing and other objects are achieved by an RF attenuator comprising at least a coaxial transmission line comprising an inner and an outer conductor; and a tapered resistive body comprised of a carbon-bonded carbon fiber composite having a bulk density less than 2 g/cc and bulk resistivity greater than 0.2 ohm.cm, the body disposed between the inner and the outer conductors, the resistive body maintaining thermal contact with at least one of the conductors.

In accordance with a second aspect of this invention, a method of making an RF attenuator comprises the steps of making a resistive body; forming the resistive body to a desired, generally tapering shape; and disposing the tapered resistive body between the inner and outer conductors of a coaxial transmission line such that the resistive body maintains thermal contact with at least one of the conductors.

In accordance with a third aspect of this invention, an RF attenuator comprises at least a waveguide transmission line comprising an interior cavity and an outer conductor; and a tapered resistive body comprised of a carbon-bonded carbon fiber composite having a bulk density less than 2 g/cc and bulk resistivity greater than 0.2 ohm.cm, the resistive body disposed within the inner cavity, and maintaining thermal contact with the outer conductor.

In accordance with a fourth aspect of this invention, a method of making an RF attenuator comprises the steps of making a resistive body; forming the resistive body to a desired, generally tapering shape; and disposing the tapered resistive body within the cavity of a waveguide transmission line such that the resistive body maintains thermal contact with the conductive wall of the waveguide.

Further and other aspects of the present invention will become apparent from the description contained herein.

DETAILED DESCRIPTION OF THE PREFERRED EMBODIMENT

The above objects and advantages are accomplished by the present invention in which a lossy material is formed into a selected, generally tapered geometry, and disposed within either a coaxial or a waveguide transmission line. In a preferred embodiment of the invention shown at 10 in FIG. 1, the lossy material is a low-density carbon-carbon composite (carbon-bonded carbon fibers, or CBCF) machined to desired dimensions, and brazed onto selected surfaces of the conductor which is preferably copper. The CBCF may be further machined after the brazing operation, if desired.

The brazing operation is preferably facilitated by the use of the novel brazing method described in our U.S. Pat. No. 5,648,180 entitled "Method for Joining Carbon-Carbon Composites to Metals" incorporated herein by reference in its entirety. The brazing method provides means for sealing the low-density CBCF surface prior to brazing to prevent infiltration or "wicking" of the braze alloy into the CBCF body. The sealing is preferably accomplished by applying a coating of pitch or resin to the CBCF body, and carbonizing this coating to yield a completely carbonaceous, dense (impermeable) layer on the CBCF. The braze alloy that is used is preferably of such composition and melting temperature that it will not be adversely affected by subsequent brazing or soldering operations as the device is further assembled.

EXAMPLE I

Coaxial Transmission line

Figure 2:
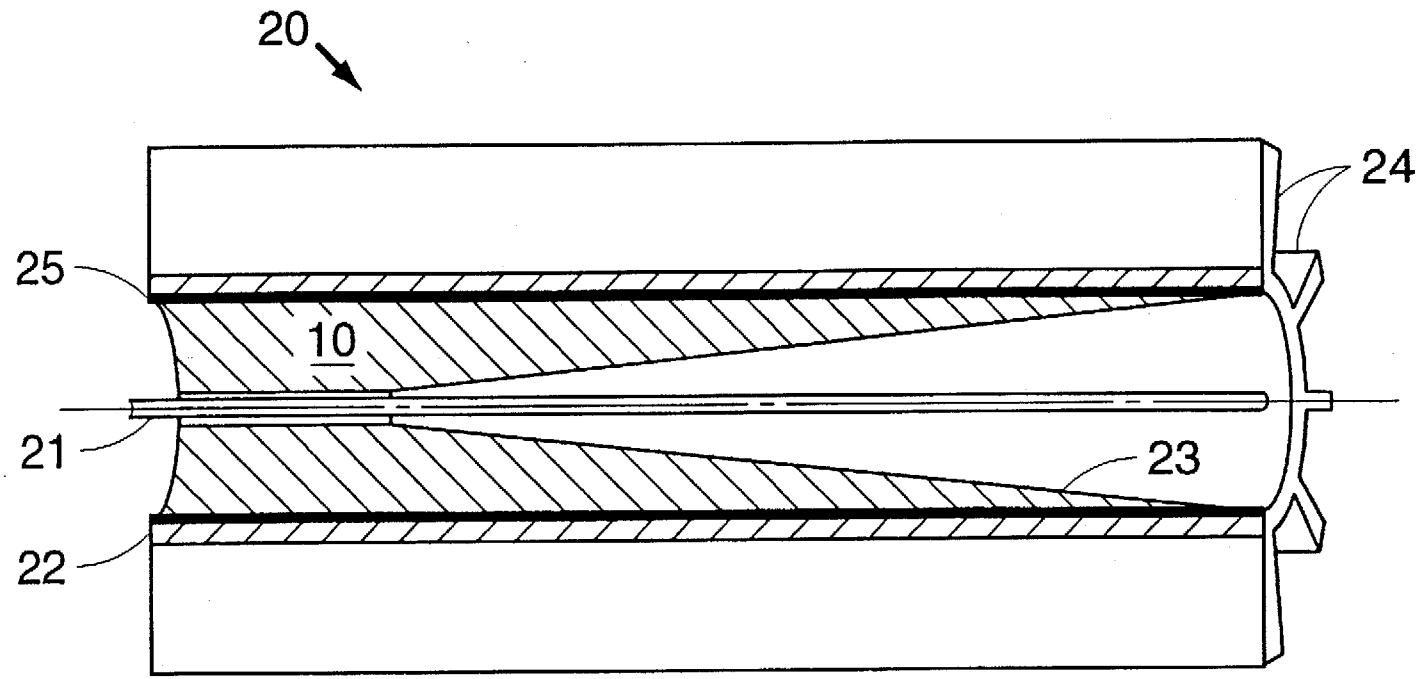
FIG. 2 is a cross-sectional diagram of an assembled air-cooled coaxial microwave load according to the present invention, taken along its center axis.

In this embodiment, shown in FIG. 2, the RF load 20 is constructed as a section of coaxial transmission line in which a central conductor 21 is preferably copper. A bulk resistive material such as carbon-bonded carbon-fiber composite (CBCF) 10 is machined to a generally cylindrical shape whose outside diameter fits within, the inside diameter of the outer conductor 22. The inside diameter of the carbon-carbon composite 10 tapers linearly along part of its length 23, thereby achieving a gradation in the effective impedance of the coaxial transmission line.

One procedure for making the CBCF composite is presented in detail in our U.S. Pat. No. 5,243,464, which is incorporated herein by reference in its entirety.

Figure 1:
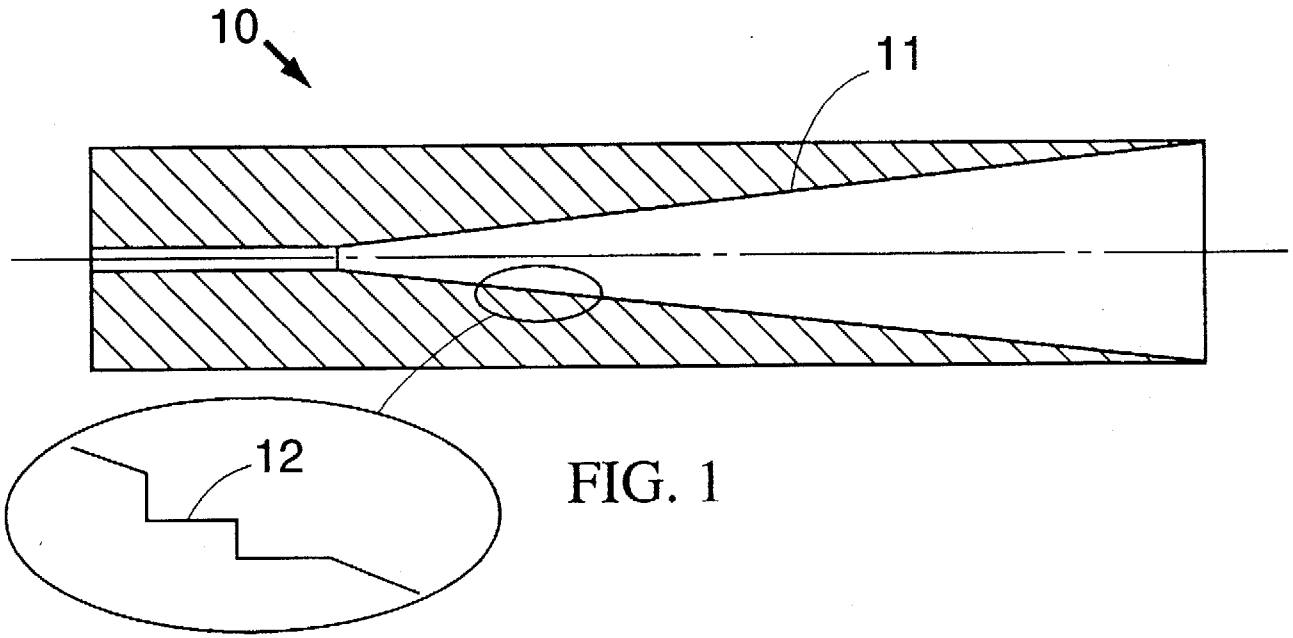
FIG. 1 is a cross-sectional diagram of a tapered, generally cylindrical body of a lossy material according to the present invention, taken along its center axis. Both a smooth taper 11 and a stepped taper 12 are shown as alternate embodiments on the present invention.

A billet of CBCF having a bulk density of about 0.25 g/cc and a bulk resistivity of about 1/2 ohm-cm is machined into the tapered shape shown in at 11 FIG. 1. In this example, the inside diameter was about 0.125 inches, and the outer diameter was about 0.300 inches. The tapered length was about 3 inches and the untapered length was about 1.5 inches. When inserted into a coaxial transmission line as shown in FIG. 2, we discovered, surprisingly, that this structure had a loss of about 20 dB. Calculations showed that by extending the tapered region to a length of 5 inches, the insertion loss could be increased to about 30 to 40 dB.

In many applications, especially at high power, the CBCF 10 must be actively cooled to remove the heat generated during dissipation of RF energy. One cooling means is shown in FIG. 2, in which the outer conductor 22 is provided with fins 24 on its surface. To facilitate cooling, it is desirable to maintain good thermal coupling between the resistive material and the outside wall of the device. One means of doing so is to braze or solder the resistive material directly to the outer conductor as shown generally at 25. The forced flow of air across the fins will accommodate operation at power levels up to a few hundred watts.

Figure 3:
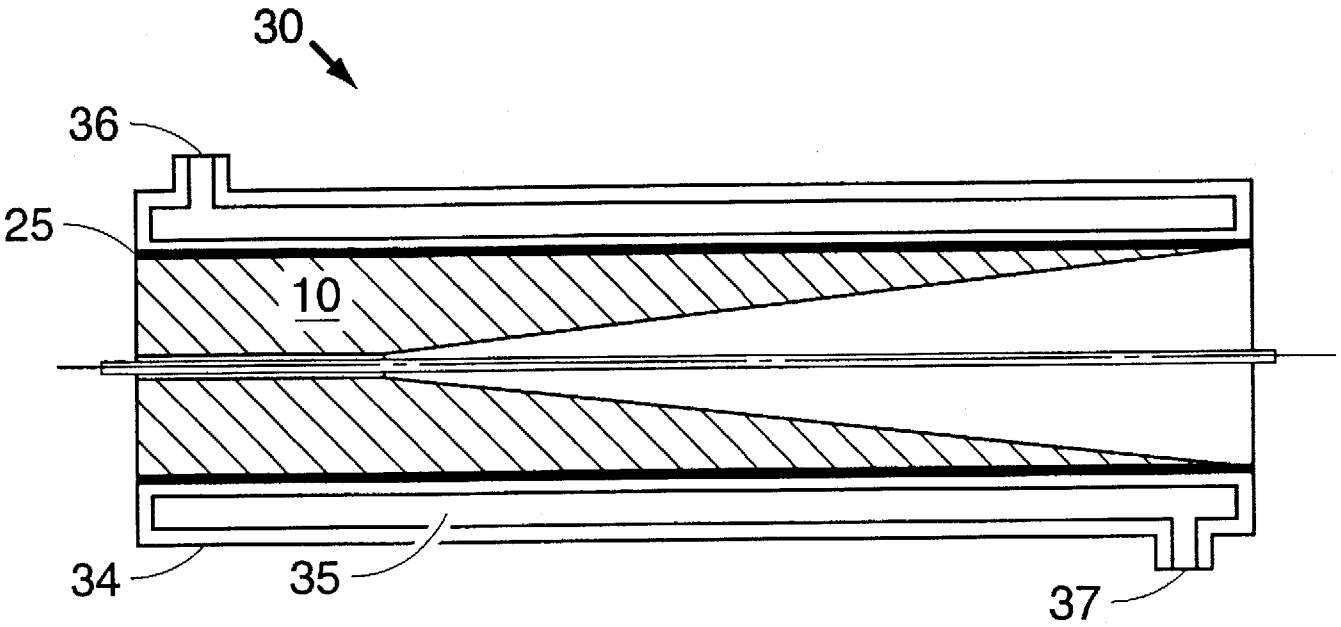
FIG. 3 is a cross-sectional diagram of an assembled water-cooled coaxial microwave load according to the present invention, taken along its center axis.

For operation at greater power levels, say a kilowatt or more, a water-cooled load 30 is desirable as shown in FIG. 3. In FIG. 3, the fins have been replaced by a water jacket 34 though which water or another liquid coolant 35 circulates via inlet 36 and outlet 37.

The load may be provided with end caps and a hermetic seal (not shown) to prevent the accumulation of moisture or other contaminants within the body of the load. The end caps are preferably of an insulating material such as ceramic, glass, or polymer. It will be appreciated by those skilled in the art that a variety of end connections may be used that are compatible with other standard circuit connectors used within the industry. Typical of the art are connectors defined in Military Specification MIL-C-39012 and MIL-STD-348.

EXAMPLE II

Microwave Waveguide

Figure 4:
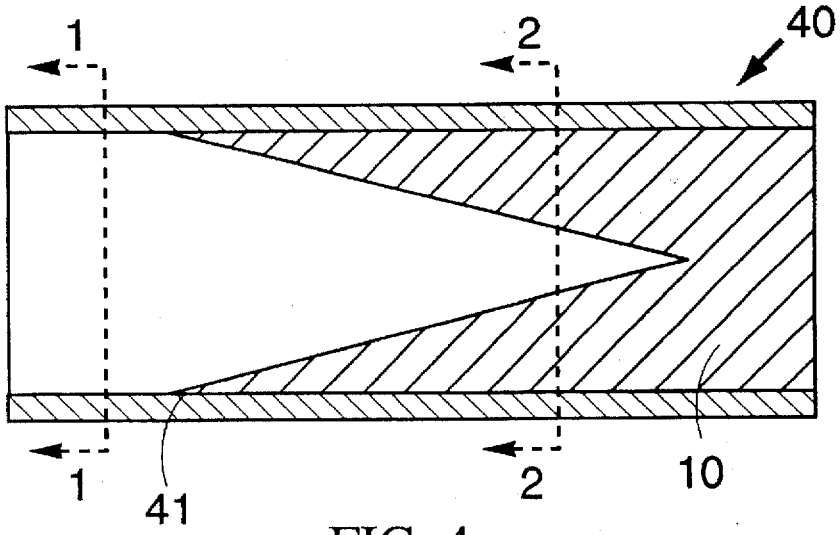
FIG. 4 is a cross-sectional diagram of an unridged waveguide microwave load according to the present invention, taken along its center axis.
Figure 4A:
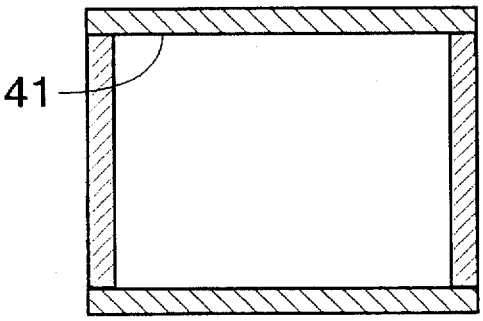
FIG. 4A is a sectional view of a rectangular embodiment of the invention through the plane of sect. 1—1 of FIG. 4.
Figure 4B:
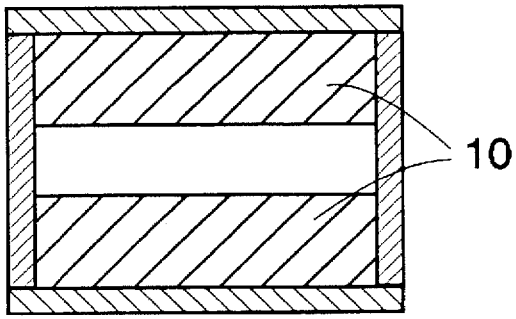
FIG. 4B is a sectional view of the same rectangular embodiment of the invention through the plane of sect. 2—2 of FIG. 4.
Figure 4C:
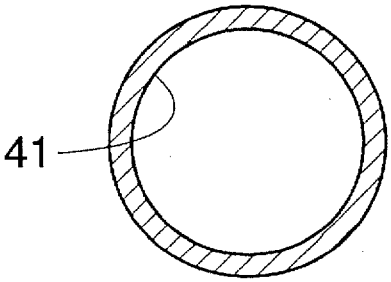
FIG. 4C is a sectional view of a cylindrical embodiment of the invention through the plane of sect. 1—1 of FIG. 4.
Figure 4D:
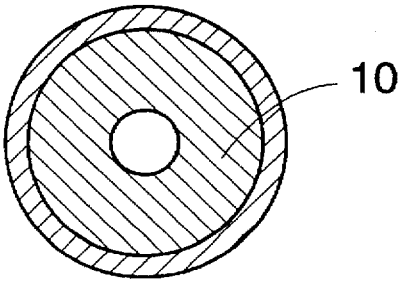
FIG. 4D is a sectional view of the same cylindrical embodiment of the invention through the plane of sect. 2—2 of FIG. 4.
Figure 5:
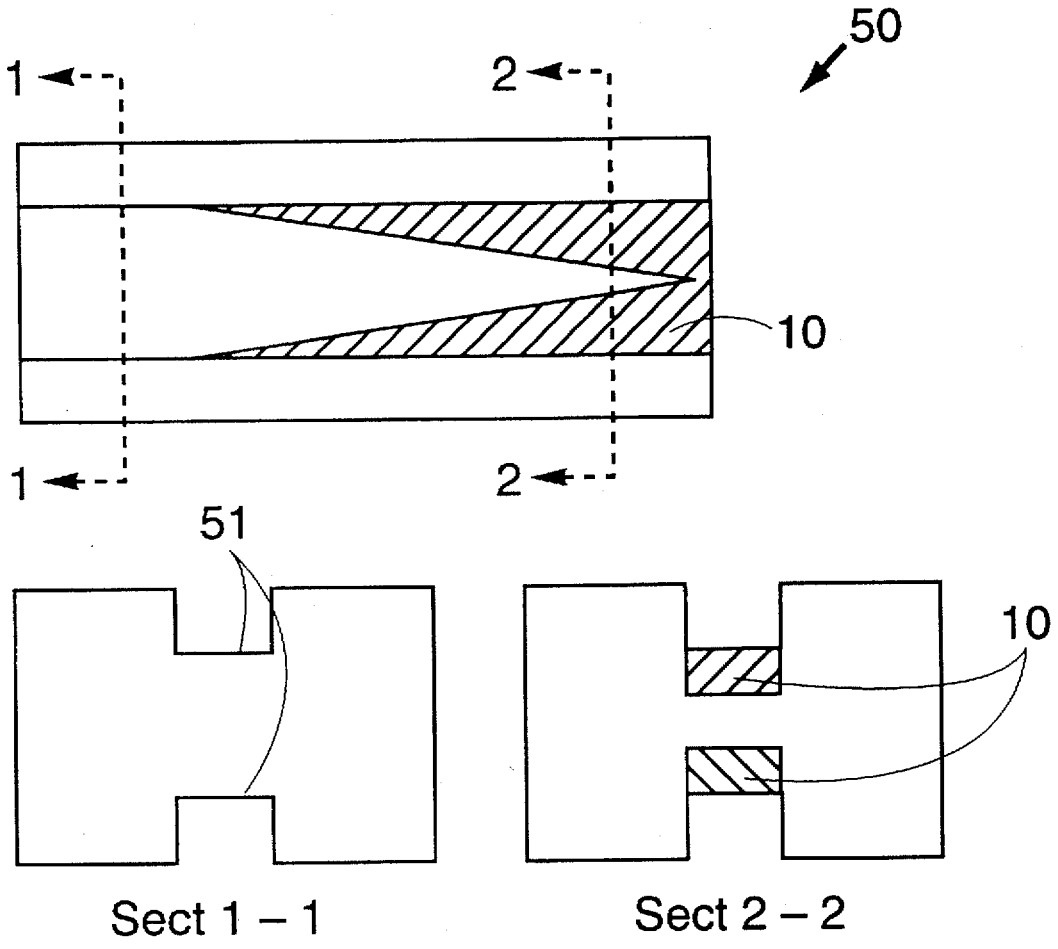
FIG. 5 is a cross-sectional diagram of a ridged waveguide load according to the present invention, taken along its center axis.

Many RF circuits, particularly those operating at microwave frequencies, often employ waveguides rather than coaxial transmission lines because they generally have lower losses. FIG. 4 shows the lossy low-density CBCF composite 10 described hereinabove machined to desired dimensions, and brazed onto the inner surface(s) 41 of a typical microwave waveguide 40. In this case, the waveguide may be either circular or rectangular in cross section; with the rectangular waveguide (FIG. 4*a*, 4*b*) being of the single-ridged, dual-ridged, or unridged varieties. In the case of a circular waveguide, (FIG. 4*c*, 4*d*) the inside diameter of the resistive material may be tapered linearly to form a generally conical surface, whereas in a rectangular waveguide the resistive material may be tapered along one or both of the axial planes of the waveguide (FIG. 4). In the case of a ridged Waveguide 50, the resistive material 10 is preferably applied to the surface 51 of the ridge (FIG. 5).

In both examples above, the resistive CBCF material was tapered in a smooth, generally linear fashion. Skilled artisans will appreciate that many types of taper may he used, including linear, sinusoidal, logarithmic, and others. For some applications, an acceptable degree of grading can be achieved by forming the taper as a series of discrete steps indicated at 12 in the modified view shown in FIG. 1. Even in this case, the grading can be better controlled and more uniform than is achievable by painting or otherwise depositing a thin coating of, say, colloidal graphite. Furthermore, skilled artisans will appreciate at once that our invention provides a means for dissipating the RF power uniformly throughout a volume (or bulk) of resistive CBCF material rather than in a thin layer, thereby making attenuators and loads designed according to this invention inherently more robust.

Some other attendant features and advantages of our invention are as follows. CBCF is relatively inexpensive, easily machined to close tolerances, and can be securely brazed into a copper, brass or aluminum waveguide or used as a stand-alone load element. Machined CBCF is more reproducible than carbon films or coatings. Brazing gives good thermal and electrical contact with the outer wall of the waveguide. Common failure modes of conventional devices (solder melting, carbon film spalling) are eliminated, giving a much more robust device. CBCF is very lightweight. Attenuators and loads made of machined CBCF composite are thermal shock resistant. Ferrite materials (which require sintering and grinding) and silicon carbide (which must be machined) can be eliminated from the design of RF loads.

While several preferred embodiments of the improved RF load have been shown and described, it will be understood that such descriptions are not intended to limit the disclosure, but rather it is intended to cover all modifications and alternate methods falling within the spirit and scope of the invention as defined in the appended claims or their equivalents.

We claim:

1. An RF attenuator comprising at least:

a coaxial transmission line comprising an inner and an outer conductor; and, a tapered resistive body disposed between said inner and said outer conductors, said resistive body comprised of a carbon-bonded carbon fiber composite having a bulk density less than 2 g/cc, and bulk resistivity greater than 0.2 ohm.cm, and said resistive body maintaining thermal contact with at least one of said conductors.

2. The RF attenuator of claim 1 wherein said tapered resistive body is generally cylindrical and said taper is substantially linear along some portion of its length.

3. The RF attenuator of claim 1 wherein said tapered resistive body is tapered in a stepwise fashion along some portion of its length.

4. The RF attenuator of claim 1 wherein said inner and said outer conductors are a metal selected from the group comprising copper, copper alloys, aluminum, and aluminum alloys.

5. The RF attenuator of claim 1 wherein said resistive body is affixed to said inner and said outer conductors by brazing or soldering.

6. The RF attenuator of claim 1 further comprising cooling means for dissipating heat generated during operation of said attenuator.

7. The RF attenuator of claim 6 wherein said cooling means includes fins upon the surface of said outer conductor, said fins serving to facilitate the transfer of heat to the surrounding environment.

8. The RF attenuator of claim 6 wherein said cooling means includes a liquid coolant disposed in contact with at least one of said inner and said outer conductors.

9. An RF attenuator comprising at least:

a waveguide transmission line comprising an interior cavity and an outer conductor; and, a tapered resistive body disposed within said inner cavity, said resistive body comprised of a carbon-bonded carbon fiber composite having a bulk density less than 2 g/cc, and bulk resistivity greater than 0.2 ohm.cm, and said resistive body maintaining thermal contact with said outer conductor.

10. The RF attenuator of claim 9 wherein said tapered resistive body is generally cylindrical and said taper is substantially linear along some portion of its length.

11. The RF attenuator of claim 9 wherein said tapered resistive body is tapered in a stepwise fashion along some portion of its length.

12. The RF attenuator of claim 9 wherein said outer conductor is a metal selected from the group comprising copper, copper alloys, aluminum, and aluminum alloys.

13. The RF attenuator of claim 9 wherein said resistive body is affixed to said outer conductor by brazing or soldering.

14. The RF attenuator of claim 9 further comprising cooling means for dissipating heat generated during operation of said attenuator.

15. The RF attenuator of claim 14 wherein said cooling means includes fins upon the surface of said outer conductor, said fins serving to facilitate the transfer of heat to the surrounding environment.

16. The RF attenuator of claim 14 wherein said cooling means includes a liquid coolant disposed in contact with said outer conductor.

* * * * *